US012338088B2

(12) United States Patent
Nakagawa et al.

(10) Patent No.: US 12,338,088 B2
(45) Date of Patent: Jun. 24, 2025

(54) DOCUMENT SHEET CONVEYING DEVICE CAPABLE OF ACHIEVING LARGE CAPACITY OF SHEET FEED TRAY

(71) Applicant: KYOCERA Document Solutions Inc., Osaka (JP)

(72) Inventors: Takafumi Nakagawa, Osaka (JP); Yoshitaka Tokoro, Osaka (JP); Ren Isoda, Osaka (JP); Hirofumi Hagihara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 225 days.

(21) Appl. No.: 18/326,575

(22) Filed: May 31, 2023

(65) Prior Publication Data

US 2023/0391567 A1 Dec. 7, 2023

(30) Foreign Application Priority Data

Jun. 1, 2022 (JP) ..... 2022-089527

(51) Int. Cl.
*B65H 1/04* (2006.01)
*B65H 1/14* (2006.01)

(52) U.S. Cl.
CPC ..... *B65H 1/04* (2013.01); *B65H 1/14* (2013.01); *B65H 2402/32* (2013.01); *B65H 2405/1132* (2013.01); *B65H 2405/1134* (2013.01); *B65H 2405/3321* (2013.01)

(58) Field of Classification Search
CPC ..... B65H 1/04; B65H 1/08; B65H 1/14
See application file for complete search history.

(56) References Cited

U.S. PATENT DOCUMENTS 5,009,410 A * 4/1991 Fujii ..... B02C 18/0007 271/127
7,267,335 B2 * 9/2007 Kubo ..... B65H 1/14 271/127
9,592,973 B2 * 3/2017 Kushida ..... B65H 3/0684
2008/0150219 A1 * 6/2008 Nishizawa ..... G03G 15/6502 271/127
2022/0185606 A1 * 6/2022 Hagihara ..... B65H 1/18

FOREIGN PATENT DOCUMENTS

JP 2005008283 A 1/2005

* cited by examiner

*Primary Examiner* — Prasad V Gokhale
(74) *Attorney, Agent, or Firm* — Alleman Hall & Tuttle LLP

(57) ABSTRACT

A document sheet conveying device includes a sheet feed tray lift mechanism, a top plate portion, a fixed wall portion, and a lifted wall portion. The sheet feed tray lift mechanism lifts up and down a sheet feed tray. The top plate portion is adjacent to the sheet feed tray at a downstream side, in a sheet feed direction, of the sheet feed tray, and is contacted by a lower surface of a document sheet having been fed. The fixed wall portion is provided to extend downward from an upstream end, in the sheet feed direction, of the top plate portion, and the position of the fixed wall portion is fixed. The lifted wall portion extends upward from a downstream end of the sheet feed tray in the sheet feed direction and is lifted up and down along the fixed wall portion together with the sheet feed tray.

4 Claims, 9 Drawing Sheets

DOCUMENT SHEET CONVEYING DEVICE CAPABLE OF ACHIEVING LARGE CAPACITY OF SHEET FEED TRAY

INCORPORATION BY REFERENCE

This application is based upon and claims the benefit of priority from the corresponding Japanese Patent Application No. 2022-089527 filed on Jun. 1, 2022, the entire contents of which are incorporated herein by reference.

BACKGROUND

The present disclosure relates to a document sheet conveying device for conveying a document sheet to a reading position of an image reading device.

There is known a document sheet conveying device configured to convey a document sheet to a reading position of an image reading device. The document sheet conveying device, for example, includes: a sheet feed tray on which document sheets are stacked; a sheet discharge tray provided below the sheet feed tray; and a conveyance mechanism configured to convey a document sheet along a conveyance path that extends from the sheet feed tray to the sheet discharge tray via the reading position of the image reading device.

The larger the capacity (amount of stackable document sheets) of the sheet feed tray and the sheet discharge tray is, the higher the convenience of the document sheet conveying device is. Therefore, conventionally, a technology for achieving a large capacity of the document sheet conveying device has been studied. For example, there is known a document sheet feeding device including: a lift means for lifting up and down a sheet feed tray; and a lift control means for lifting up the sheet feed tray in response to a feeding of a document sheet from the sheet feed tray.

SUMMARY

A document sheet conveying device according to an aspect of the present disclosure includes a sheet feed tray, a sheet feed mechanism, a sheet feed tray lift mechanism, a top plate portion, a fixed wall portion, and a lifted wall portion. A document sheet is stacked on the sheet feed tray. The sheet feed mechanism feeds, in a predetermined sheet feed direction, the document sheet stacked on the sheet feed tray. The sheet feed tray lift mechanism lifts up and down the sheet feed tray. The top plate portion is adjacent to the sheet feed tray at a downstream side, in the sheet feed direction, of the sheet feed tray, and is contacted by a lower surface of the document sheet having been fed. The fixed wall portion is provided to extend downward from an upstream end, in the sheet feed direction, of the top plate portion, and the position of the fixed wall portion is fixed. The lifted wall portion extends upward from a downstream end of the sheet feed tray in the sheet feed direction and is lifted up and down along the fixed wall portion together with the sheet feed tray.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes, with reference to the accompanying drawings, a document sheet conveying device 120 and an image forming apparatus 100 according to an embodiment of the present disclosure.

Figure 1:
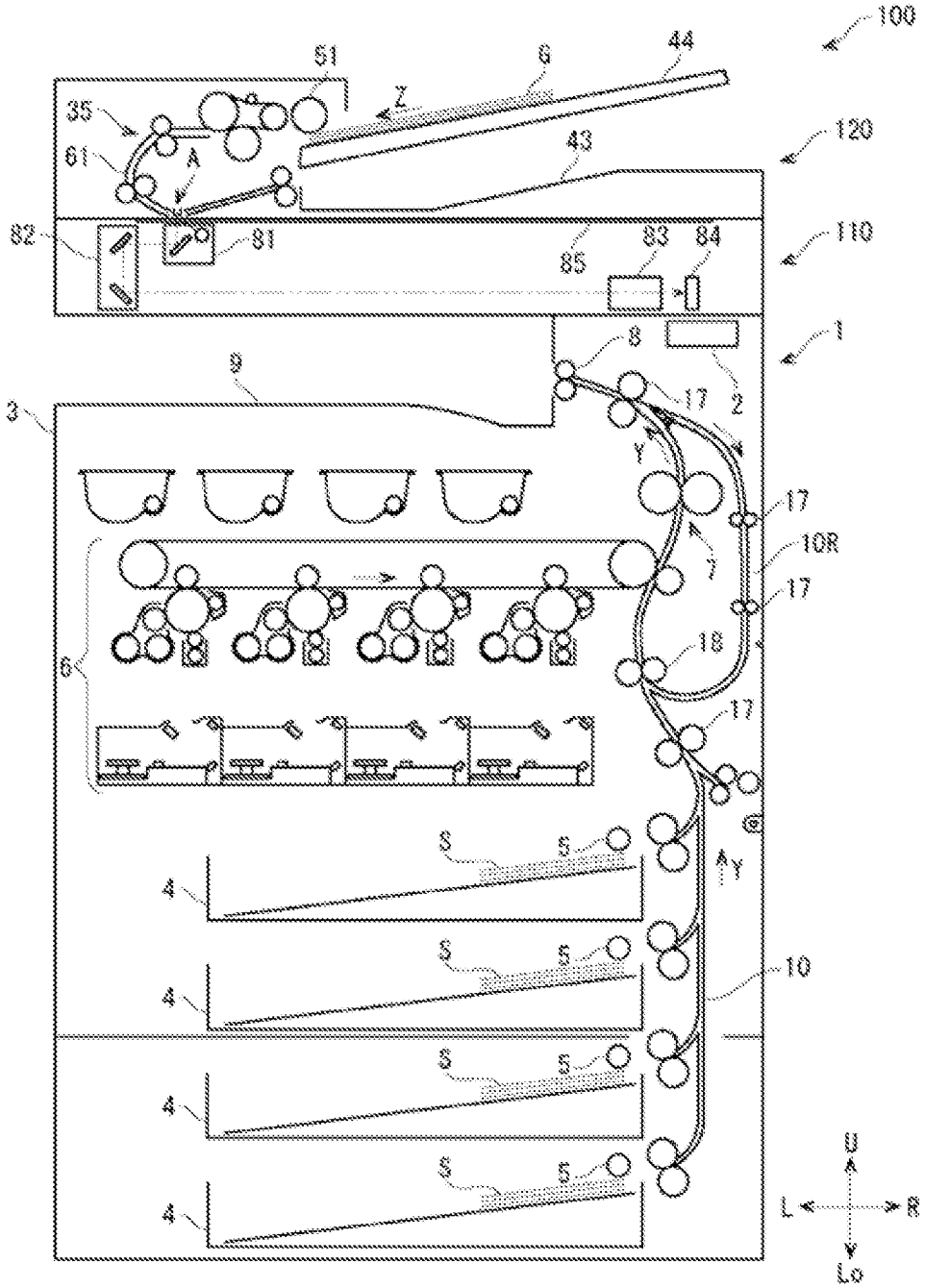
FIG. 1 is a front diagram schematically showing an internal configuration of an image forming apparatus according to an embodiment of the present disclosure.

First, the entire configuration of the image forming apparatus 100 is described. FIG. 1 is a front diagram schematically showing an internal configuration of the image forming apparatus 100. In the following description, it is supposed that the surface of the paper in FIG. 1 is the front side (front) of the image forming apparatus 100, and the left and right directions are based on a direction in which the image forming apparatus 100 is viewed from the front. In each drawing, U, Lo, L, R, Fr, and Rr respectively represent up, low (down), left, right, front, and rear.

The image forming apparatus 100 includes a printer 1, a scanner 110, and the document sheet conveying device 120. The scanner 110 is provided above the printer 1, and the document sheet conveying device 120 is provided above the scanner 110. The document sheet conveying device 120 conveys a document sheet G via a reading position A of the scanner 110. The scanner 110 is an image scanner of a flat bed type, and generates image data by reading the document sheet G. The printer 1 forms an image on a sheet S based on the image data. It is noted that although the present embodiment shows an example in which the printer 1 forms the image by an electrophotographic method, the printer 1 may be configured to form the image by another method (for example, an inkjet method).

The printer 1 includes a main-body housing 3 of a rectangular parallelepiped shape. In a lower part of the main-body housing 3, a sheet feed cassette 4 and a sheet feed roller 5 are provided, wherein the sheet(s) S is stored in the sheet feed cassette 4, and the sheet feed roller 5 feeds the sheet S from the sheet feed cassette 4 rightward. Above the sheet feed cassette 4, an image creating device 6 configured to form a toner image by the electrophotographic method is provided, and on the upper right side of the image creating device 6, a fixing device 7 configured to fix the toner image to the sheet S is provided. Above the fixing device 7, a sheet discharge roller 8 and a sheet discharge tray 9 are provided, wherein the sheet discharge roller 8 discharges the sheet S with the toner image fixed thereto, and the sheet S discharged is stacked on the sheet discharge tray 9.

Inside the main-body housing 3, a conveyance path 10 extending from the sheet feed roller 5 to the sheet discharge roller 8 via the image creating device 6 and the fixing device 7 is provided. The conveyance path 10 is mainly formed of plate-like members facing each other with a space for passing through the sheet S therebetween, and conveyance rollers 17 configured to pinch and convey the sheet S are provided at a plurality of positions in the conveyance path 10 along a conveyance direction Y A registration roller 18 is provided at an upstream of the image creating device 6 in the conveyance direction Y A reverse conveyance path 10R is provided on the right side of the fixing device 7, wherein the reverse conveyance path 10R branches from the conveyance path 10 at a downstream of the fixing device 7 in the conveyance direction Y and merges with the conveyance path 10 at an upstream of the registration roller 18 in the conveyance direction Y.

A control portion 2 includes a calculation portion and a storage portion (both not shown). The calculation portion is, for example, a CPU (Central Processing Unit). The storage portion includes storage media such as a ROM (Read Only Memory), a RAM (Random Access Memory), and an EEPROM (Electrically Erasable Programmable Read Only Memory). The calculation portion performs various types of processes by reading and executing control programs stored in the storage portion. It is noted that the control portion 2 may be achieved only by an integrated circuit(s) without using software.

On the front side of the scanner 110, a display/operation portion (not shown) is provided. The display/operation portion includes a display panel, a touch panel provided overlaid on a display surface of the display panel, and a keypad adjacent to the display panel (not shown). The control portion 2 displays, on the display panel, a screen representing an operation menu or a status of the printer 1 or the scanner 110, and controls each portion of the printer 1 or the scanner 110 in response to an operation detected by the touch panel or the keypad.

The basic image forming operation of the printer 1 is as follows. Upon input of a single-sided print job from the display/operation portion, an external computer or the like to the printer 1, the sheet feed roller 5 feeds the sheet S from the sheet feed cassette 4 to the conveyance path 10, the registration roller 18, with its rotation stopped, corrects a skew of the sheet S, and the registration roller 18 feeds the sheet S to the image creating device 6 at a predetermined timing. The image creating device 6 forms a toner image on the sheet S by the electrophotographic method. Subsequently, the fixing device 7 fixes the toner image to the sheet S by melting the toner image while pinching and conveying the sheet S, and the sheet discharge roller 8 discharges the sheet S to the sheet discharge tray 9. In a case of a double-sided printing, the sheet S with the toner image fixed to its first surface is sent to the conveyance path 10 via the reverse conveyance path 10R, and a toner image is transferred to its second surface.

[Scanner]

The scanner 110 includes a first carriage 81 including a light source and a reflection mirror, a second carriage 82 including two reflection mirrors, a lens 83 configured to form an image of light, an imaging element 84 configured to convert the formed image of light to image data, and a contact glass 85 on which the document sheet G is placed.

The basic document sheet reading operation of the scanner 110 is as follows. When the user has placed the document sheet G on an upper surface of the contact glass 85 and instructed the scanner 110 to read, the first carriage 81 moves rightward at a speed V, and, in conjunction with this, the second carriage 82 moves rightward at a speed V/2. During the same period, the light source emits light toward the document sheet G, a reflection light reflected by the document sheet G is reflected by the reflection mirror of the first carriage 81 and the reflection mirrors of the second carriage 82 to be guided to the lens 83, and an image of the light is formed in the imaging element 84 and converted to an image signal. The image signal is output to the control portion 2 of the printer 1 and converted to the image data.

[Document Sheet Conveying Device]

Figure 2:
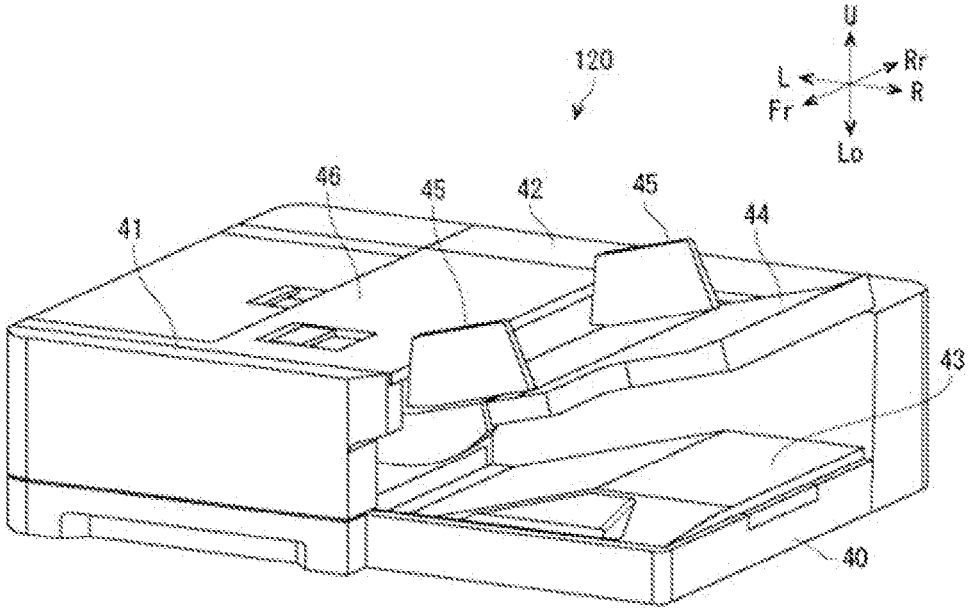
FIG. 2 is a perspective diagram showing an outer appearance of a document sheet conveying device according to the embodiment of the present disclosure.
Figure 3:
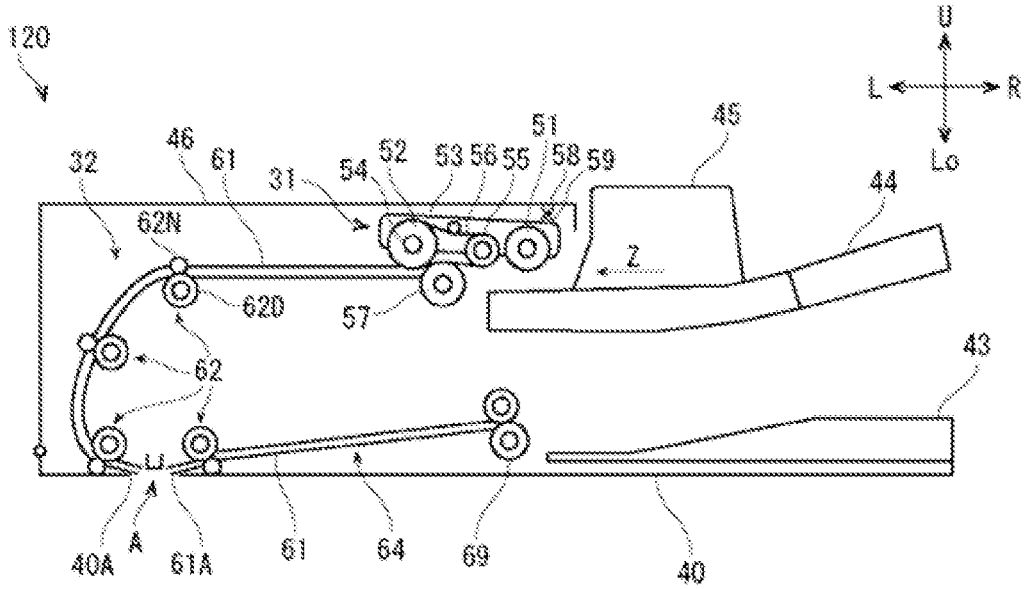
FIG. 3 is a front diagram schematically showing a sheet feed mechanism and a conveyance mechanism according to the embodiment of the present disclosure.
Figure 4:
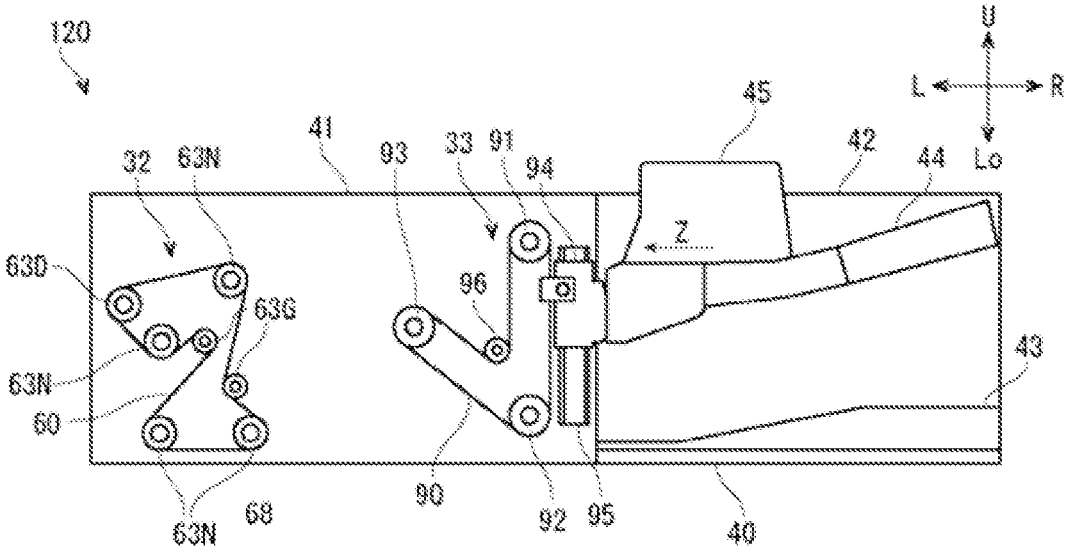
FIG. 4 is a front diagram schematically showing the conveyance mechanism and a sheet feed tray lift mechanism according to the embodiment of the present disclosure.
Figure 5:
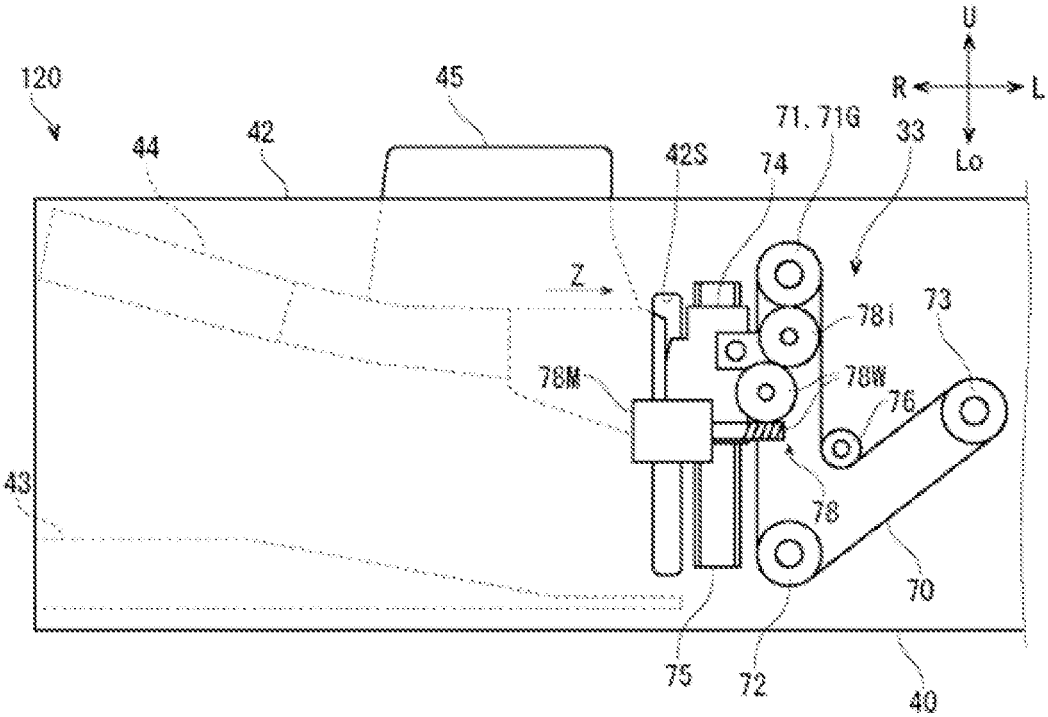
FIG. 5 is a rear diagram schematically showing the sheet feed tray lift mechanism according to the embodiment of the present disclosure.
Figure 6:
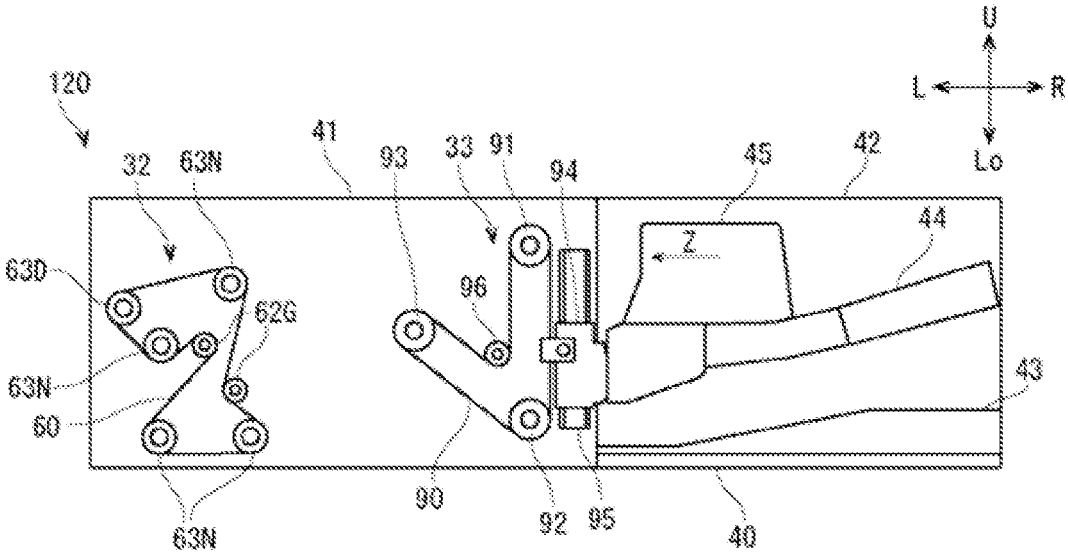
FIG. 6 is a front diagram schematically showing the conveyance mechanism and the sheet feed tray lift mechanism according to the embodiment of the present disclosure.

Next, the document sheet conveying device 120 is described. FIG. 2 is a perspective diagram showing an outer appearance of the document sheet conveying device 120. FIG. 3 is a front diagram schematically showing a sheet feed mechanism 31 and a conveyance mechanism 32. FIG. 4 and FIG. 6 are front diagrams schematically showing the conveyance mechanism 32 and a sheet feed tray lift mechanism 33. FIG. 5 is a rear diagram schematically showing the sheet feed tray lift mechanism 33. Of these, FIG. 3, FIG. 4, and FIG. 5 show a state where a sheet feed tray 44 is located at an upper-limit position, and FIG. 6 shows a state where the sheet feed tray 44 is located near a lower-limit position.

The document sheet conveying device 120 (see FIG. 2, FIG. 3) includes a bottom portion 40, a first wall portion 41, and a second wall portion 42, wherein the bottom portion 40 is formed in an approximately rectangular, flat shape, the first wall portion 41 and the second wall portion 42 face each other in a front-rear direction (a width direction crossing a sheet feed direction Z of feeding the document sheet G). A rear edge part of the bottom portion 40 is hinge-connected with a rear end of the contact glass 85 (see FIG. 1) of the scanner 110. The bottom portion 40 also has a function of a pressing plate to press the document sheet G on the contact glass 85. The first wall portion 41 extends from a left end part to a center part of a front edge part of the bottom portion 40. The second wall portion 42 extends in the entirety of a rear edge part of the bottom portion 40. A cover portion 46 covers an upper part and a left side part of a space between the first wall portion 41 and the second wall portion 42. A lower left end part of the cover portion 46 is hinge-connected with a left end part of the bottom portion 40.

[Sheet Feed Tray]

The sheet feed tray 44 (see FIG. 2, FIG. 3) is provided on the right side of the center of the document sheet conveying device 120 in a left-right direction and on the front side of the second wall portion 42. The sheet feed tray 44 is a plate-like member that is inclined to be lowered to the left. On an upper surface of the sheet feed tray 44, a pair of cursors 45 for aligning end parts of the document sheet G in the front-rear direction are provided. The cursors 45 are configured to be slid in the front-rear direction.

[Discharge Tray]

A discharge tray 43 is provided below the sheet feed tray 44. The discharge tray 43 is integral with the bottom portion 40. At a center part of the discharge tray 43 in the left-right direction, an inclined surface inclined to be lowered to the left is provided.

[Sheet Feed Mechanism]

The sheet feed mechanism 31 (see FIG. 3) is provided in the space between the first wall portion 41 and the second wall portion 42. The sheet feed mechanism 31 includes a holder 53 in a shape of a box whose lower part is open. Inside the holder 53, a feed roller 51, a driven roller 55, a driving roller 52, an endless belt 56, and a retard roller 57 are disposed with the front-rear direction as an axis direction. The driven roller 55 is provided at the left of the feed roller 51. The driving roller 52 is provided at the left of the driven roller 55. The endless belt 56 is wound around the driving roller 52 and the driven roller 55. The retard roller 57 is pressed against a lower surface of a lower part of the endless belt 56.

A front end part and a rear end part of a drive shaft 54 of the driving roller 52 are supported by the first wall portion 41 and the second wall portion 42, and are connected to a drive portion (not shown) that includes a motor and a speed reduction gear. The holder 53 is supported by and swingable around the drive shaft 54. The driving force of the drive shaft 54 is transmitted to the feed roller 51 and the retard roller 57 by a transmission mechanism (not shown) such as a gear train or an endless belt.

A sensor 58 is an optical sensor of a transmission type or a reflection type provided on an inner surface of the cover portion 46. On the holder 53, a light shielding plate 59 projecting upward or sideways is provided. The sensor 58 outputs, to the control portion 2, a detection signal whose level is different depending on whether the light shielding plate 59 is shielding light from the sensor 58 or not.

[Sheet Feed Tray Lift Mechanism]

The sheet feed tray lift mechanism 33 (see FIG. 4, FIG. 5) is provided on a front surface of the first wall portion 41 and a rear surface of the second wall portion 42. A driving pulley 71 and a driven pulley 72 (see FIG. 5) are respectively provided at an upper part and a lower part of the rear surface of the second wall portion 42. A driven pulley 73 is provided at a height between the driving pulley 71 and the driven pulley 72 and the left of the driving pulley 71 and the driven pulley 72. A guide pulley 76 is provided at the upper left of the driven pulley 72 and the right of the driven pulley 73. An endless belt 70 is wound around the driving pulley 71, the driven pulleys 72, 73, and the guide pulley 76. The drive portion 78 includes a motor 78M, a worm gear 78W, an idler gear 78*i*, and a drive gear 71G. The drive gear 71G is provided at a shaft of the driving pulley 71.

Driven pulleys 91, 92, 93 and a guide pulley 96 (see FIG. 4) are provided on the front surface of the first wall portion 41 at positions respectively facing the driving pulley 71, the driven pulleys 72, 73, and the guide pulley 76. An endless belt 90 is wound around the driven pulleys 91, 92, 93 and the guide pulley 96. The driven pulley 93 is provided at a shaft common to the driven pulley 73.

A slide portion 74 (see FIG. 5) is provided at a left end part of a rear edge part of the sheet feed tray 44. The second wall portion 42 has a slit 42S elongated in an up-down direction. The slit 42S is provided at a position corresponding to the left end part of the rear edge part of the sheet feed tray 44. The slide portion 74 passes through the slit 42S and is coupled with a part of the endless belt 70 between the driving pulley 71 and the driven pulley 72.

A lift guide portion 75 is provided on the rear surface of the second wall portion 42. The lift guide portion 75 is a rail-like member elongated in the up-down direction. The slide portion 74 is configured to slide in the up-down direction along the lift guide portion 75.

A slide portion 94 (see FIG. 4) is provided at a left end part of a front edge part of the sheet feed tray 44. The slide portion 94 is coupled with a part of the endless belt 90 between the driven pulley 91 and the driven pulley 92.

A lift guide portion 95 is provided on the front surface of the first wall portion 41. The lift guide portion 95 is a rail-like member elongated in the up-down direction. The slide portion 94 is configured to slide in the up-down direction along the lift guide portion 95.

The basic operation of the sheet feed tray lift mechanism 33 is as follows. A driving force that the motor 78M generates is transmitted to the drive gear 71G via the worm gear 78W and the idler gear 78*i*, causing the drive gear 71G to rotate. The driving pulley 71 rotates together with the drive gear 71G. This causes the endless belt 70 to circumferentially rotate, and in conjunction with this, the driven pulleys 72, 73 rotate. In addition, the driven pulley 93 rotates together with the driven pulley 73, causing the endless belt 90 to circumferentially rotate in synchronization with the endless belt 70. Since the sheet feed tray 44 is coupled with the endless belts 70, 90 via the slide portions 74, 94, the sheet feed tray 44 is lifted up and down by a normal rotation and a reverse rotation of the motor 78M.

The control portion 2 causes the sheet feed tray lift mechanism 33 to lift up the sheet feed tray 44. When the upper surface of the document sheet G stacked on the sheet feed tray 44 is pressed against the feed roller 51, the holder 53 swings upward. When the holder 53 swings upward by a predetermined amount, the light shielding plate 59 shields the light of the sensor 58. At this time, an appropriate load acts between the upper surface of the document sheet G and the feed roller 51, causing the feed roller 51 to feed the document sheet G. In other words, the control portion 2 controls the sheet feed tray lift mechanism 33 in such a way as to lift up the sheet feed tray 44 as the amount of document sheets G stacked on the sheet feed tray 44 decreases.

[Conveyance Mechanism]

The conveyance mechanism 32 (see FIG. 3) includes a conveyance path 61 and a plurality of conveyance rollers 62, wherein the conveyance path 61 extends from the sheet feed mechanism 31 to a discharge roller 69 via an opening portion 40A, and the plurality of conveyance rollers 62 are disposed at the conveyance path 61. The conveyance path 61 is mainly formed of plate-like members facing each other with a space for passing through the document sheet G therebetween. The opening portion 40A is a slit elongated in the front-rear direction and is provided in a region of the bottom portion 40 that faces the first carriage 81 (see FIG. 1) located at a home position. The opening portion 40A is an example of the reading position A where the scanner 110 reads the document sheet G. At the reading position A, an opening portion 61A is provided in a plate-like member below the conveyance path 61 at a position corresponding to the opening portion 40A, and a lower surface of the document sheet G being conveyed is exposed below via the opening portion 40A and the opening portion 61A.

The conveyance rollers 62 include a driving roller 62D and a driven roller 62N (see FIG. 3). A driven pulley 63N (see FIG. 4) is provided at a shaft of the driving roller 62D.

A driving pulley 63D is connected to a drive portion (not shown) that includes a motor and a speed reduction gear. An endless belt 60 is wound around the driving pulley 63D, a plurality of driven pulleys 63N, and a guide pulley 63G. When the driving pulley 63D is driven, the endless belt 60 circumferentially rotates, and the plurality of driven pulleys 63N rotate in synchronization therewith. This causes the plurality of conveyance rollers 62 to rotate in synchronization therewith.

A guide portion 64 (FIG. 3) is provided in the conveyance path 61 at a downstream of the opening portion 40A in the sheet feed direction Z. The guide portion 64 is integrated with plate-like members that face each other in the up-down direction and is swingable around: the driving roller 62D of the conveyance roller 62 adjacent to the right side of the opening portion 40A; or the driven roller 62N. Explanation of the mechanism for swinging the guide portion 64 is omitted.

Meanwhile, in a conventional document sheet conveying device, the positioning of the document sheets G in the sheet feed direction Z is performed by a wall that faces a downstream end of the sheet feed tray 44 in the sheet feed direction Z. Therefore, to achieve a large capacity of the sheet feed tray 44, the wall needs to be enlarged in size in the up-down direction. In this case, however, a discharge outlet through which the document sheet G is discharged to the discharge tray 43 is restricted to a low position, making it difficult to achieve a large capacity of the discharge tray 43.

On the other hand, as described in the following, the document sheet conveying device 120 according to the embodiment of the present disclosure achieves a large capacity of the sheet feed tray 44 without enlarging the size of the wall in the up-down direction at a downstream side of the sheet feed tray 44 in the sheet feed direction Z.

Figure 7:
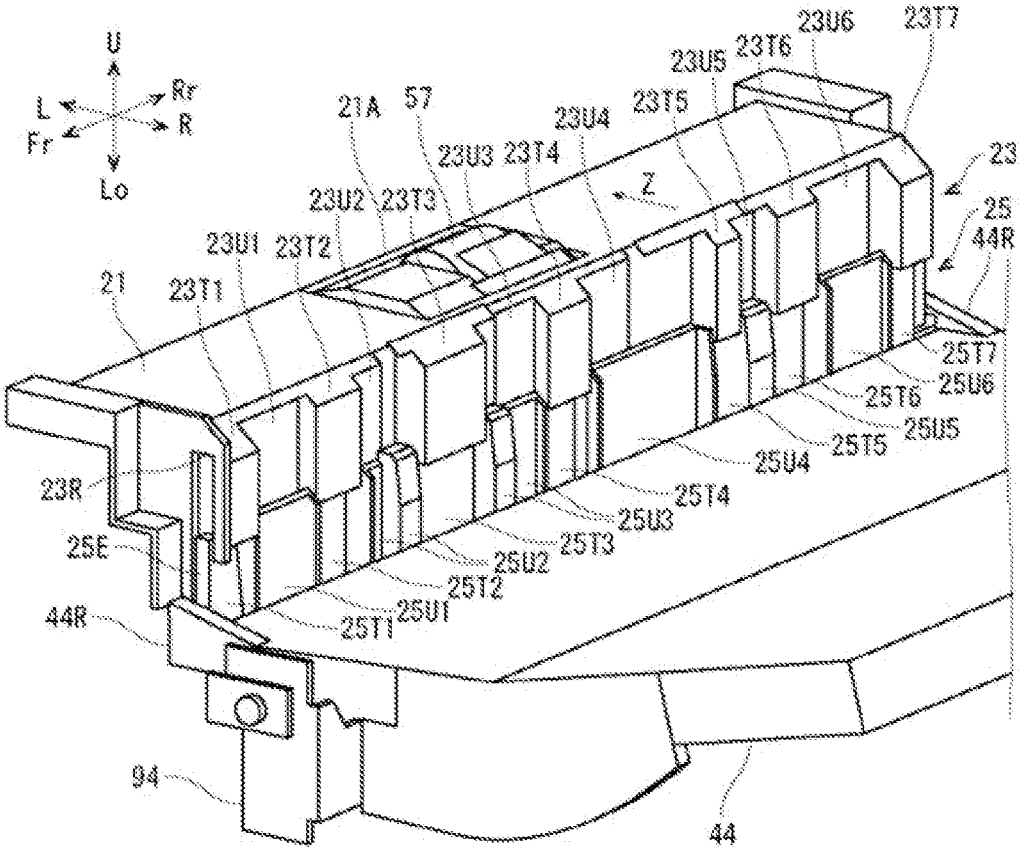
FIG. 7 is a perspective diagram showing a fixed wall portion and a lifted wall portion according to the embodiment of the present disclosure.
Figure 8:
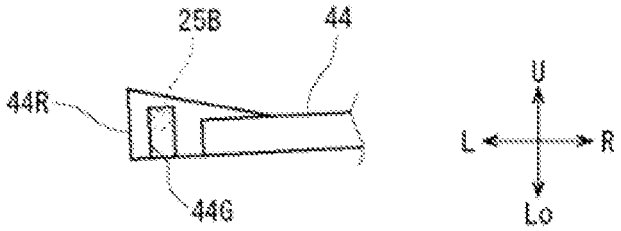
FIG. 8 is a front diagram showing a regulation portion on a rear side according to the embodiment of the present disclosure.
Figure 9:
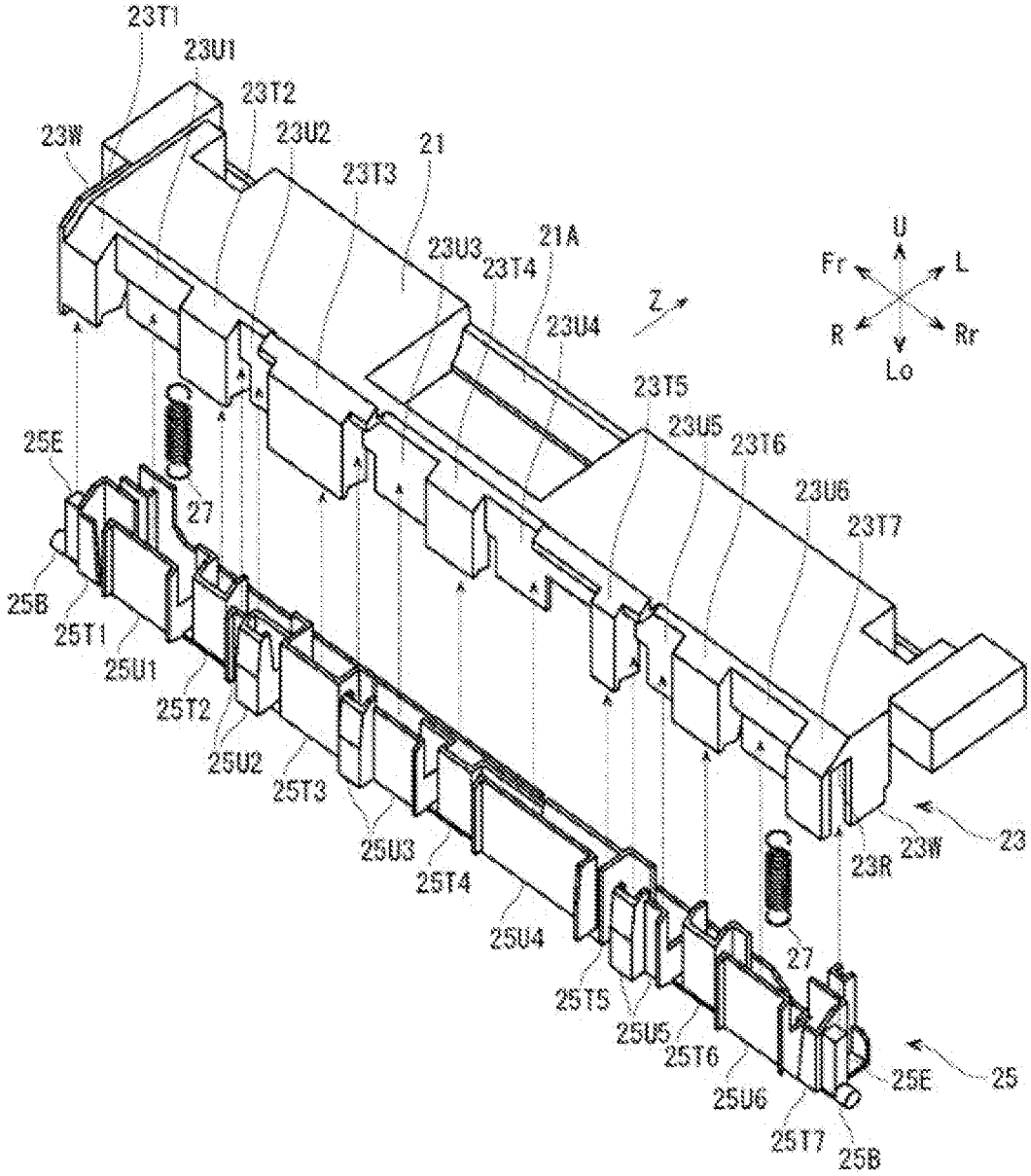
FIG. 9 is an exploded diagram showing the fixed wall portion and the lifted wall portion according to the embodiment of the present disclosure.
Figure 10:
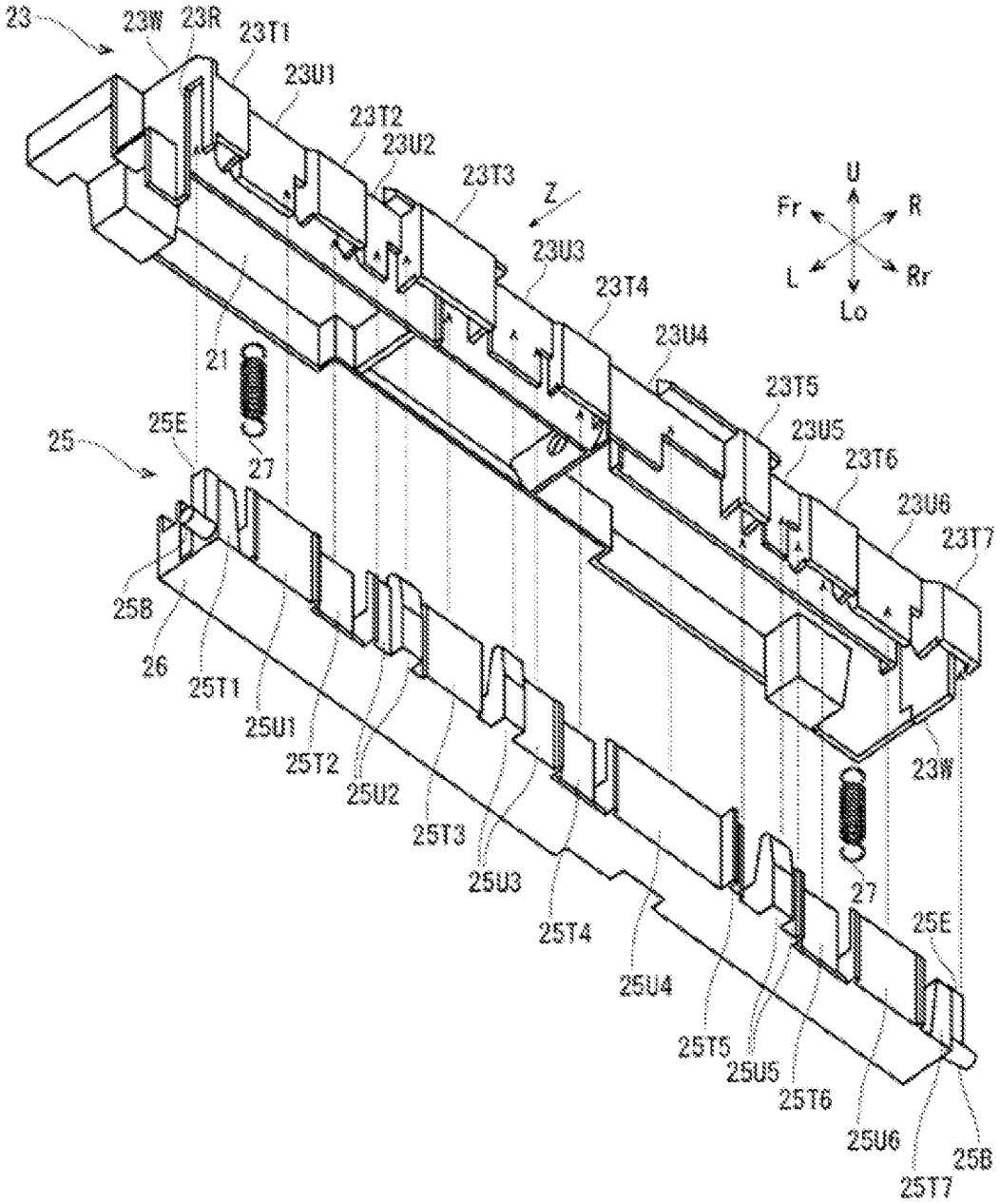
FIG. 10 is an exploded diagram showing the fixed wall portion and the lifted wall portion according to the embodiment of the present disclosure.

Next, a fixed wall portion 23 and a lifted wall portion 25 are described. FIG. 7 is a perspective diagram showing the fixed wall portion 23 and the lifted wall portion 25. FIG. 8 is a front diagram showing a regulation portion 44R on the rear side. FIG. 9 and FIG. 10 are exploded diagrams showing the fixed wall portion 23 and the lifted wall portion 25.

The document sheet conveying device 120 includes: the sheet feed tray 44 on which one or more document sheets G are stacked; the sheet feed mechanism 31 configured to feed, in a predetermined sheet feed direction Z, one of the document sheets G stacked on the sheet feed tray 44; the sheet feed tray lift mechanism 33 configured to lift up and down the sheet feed tray 44; a top plate portion 21 which is adjacent to the sheet feed tray 44 at a downstream side in the sheet feed direction Z and is contacted by a lower surface of the document sheet G having been fed; the fixed wall portion 23 which extends downward from an upstream end of the top plate portion 21 in the sheet feed direction Z and whose position is fixed; and the lifted wall portion 25 extending upward from the downstream end of the sheet feed tray 44 in the sheet feed direction Z and configured to be lifted up and down along the fixed wall portion 23 together with the sheet feed tray 44.

[Top Plate Portion]

The top plate portion 21 is provided approximately horizontally. An opening portion 21A is provided at the center of the top plate portion 21 in the front-rear direction. The retard roller 57 included in the above-described sheet feed mechanism 31 is disposed in the opening portion 21A. The document sheet G fed by the feed roller 51 is conveyed along an upper surface of the top plate portion 21 with the lower surface of the document sheet G in contact with the upper surface of the top plate portion 21.

[Fixed Wall Portion]

The fixed wall portion 23 is a rectangular member as a whole elongated in the front-rear direction, provided in an erected attitude extending downward from an upstream end of the top plate portion 21 in the sheet feed direction Z, and integrated with the top plate portion 21. The fixed wall portion 23 includes: a plurality of projection portions 23T1, 23T2, 23T3, 23T4, 23T5, 23T6, and 23T7; and a plurality of recessed portions 23U1, 23U2, 23U3, 23U4, 23U5, and 23U6. The plurality of projection portions 23T1 to 23T7 are provided along the upstream end of the top plate portion 21 in the sheet feed direction Z with intervals therebetween, project toward the sheet feed tray 44, and each have a hollow structure with their lower end portions being open. The plurality of recessed portions 23U1 to 23U6 are arranged alternately with the plurality of projection portions 23T1 to 23T7. They are arranged in the order of projection portion 23T1, recessed portion 23U1, projection portion 23T2, recessed portion 23U2, projection portion 23T3, recessed portion 23U3, projection portion 23T4, recessed portion 23U4, projection portion 23T5, recessed portion 23U5, projection portion 23T6, recessed portion 23U6, and projection portion 23T7 from the front side.

The plurality of projection portions 23T1 to 23T7 are each formed in an approximate shape of a rectangular parallelepiped wherein the size thereof in the left-right direction is smaller than the size thereof in the up-down direction. Upper end portions of the plurality of projection portions 23T1 to 23T7 and the plurality of recessed portions 23U1 to 23U6 are inclined such that the downstream sides thereof in the sheet feed direction Z are higher. The plurality of projection portions 23T1 to 23T7 may differ from each other in shape and size as shown in the drawings, or may be the same in shape and size. In addition, the plurality of recessed portions 23U1 to 23U6 may differ from each other in shape and size as shown in the drawings, or may be the same in shape and size.

[Restriction Portion]

Wall portions 23W are provided in an erected attitude extending downward from front and rear ends of the top plate portion 21. The wall portions 23W are integrated with the top plate portion 21 and the fixed wall portion 23. Restriction portions 23R are slits formed in the wall portions 23W along the up-down direction. An upper end portion of each of the slits is closed, and a lower end portion thereof is open.

[Lifted Wall Portion]

A bottom plate portion 26 is provided below the top plate portion 21, facing the top plate portion 21. The lifted wall portion 25 is provided in an erected attitude extending upward from an upstream end of the bottom plate portion 26 in the sheet feed direction Z, and integrated with the bottom plate portion 26. The lifted wall portion 25 includes: a plurality of projection fitting portions 25T1, 25T2, 25T3, 25T4, 25T5, 25T6, and 25T7; and a plurality of recessed fitting portions 25U1, 25U2, 25U3, 25U4, 25U5, and 25U6. The projection fitting portions 25T1, 25T2, 25T3, 25T4, 25T5, 25T6, and 25T7 are respectively fitted in the projection portions 23T1, 23T2, 23T3, 23T4, 23T5, 23T6, and 23T7. The recessed fitting portions 25U1, 25U2, 25U3, 25U4, 25U5, and 25U6 are respectively fitted in the recessed portions 23U1, 23U2, 23U3, 23U4, 23U5, and 23U6. As the sheet feed tray 44 is lifted up and down, the projection fitting portions 25T1 to 25T7 slide along the projection portions 23T1 to 23T7, and the recessed fitting portions 25U1 to 25U6 slide along the recessed portions 23U1 to 23U6.

End portions 25E of the lifted wall portion 25 provided at the front and rear ends thereof are respectively inserted in the above-described restriction portions 23R, and slide along the restriction portions 23R. When the end portions 25E come in contact with the upper end portions of the restriction portions 23R, lifting up of the lifted wall portion 25 is stopped since the upper end portions of the restriction portions 23R are closed. When the end portions 25E come in contact with the upper end portions of the restriction portions 23R, the upper end portion of the lifted wall portion 25 becomes equal in height to the upper end portion of the fixed wall portion 23. Projection portions 25B project in the front direction and the rear direction from the end portions 25E at the front and rear ends of the lifted wall portion 25.

[Biasing Member]

Biasing members 27 are tension coil springs provided between the top plate portion 21 and the bottom plate portion 26 in an erected attitude. Upper end portions of the biasing members 27 are attached to the lower surface of the top plate portion 21, and lower end portions thereof are attached to the upper surface of the bottom plate portion 26. Since the top plate portion 21 is fixed, the bottom plate portion 26 and the lifted wall portion 25 are biased upward.

[Regulation Portion]

The regulation portions 44R are provided to project in the sheet feed direction Z from downstream ends, in the sheet feed direction Z, of the front and rear end portions of the sheet feed tray 44 (see FIG. 7). On a front surface of the regulation portion 44R on the rear side (see FIG. 8), a groove 44G extending in the up-down direction is formed. The upper end portion of the groove 44G is closed, and the lower end portion thereof is open. On a rear surface of the regulation portion 44R on the front side, a groove 44G similar to that of the regulation portion 44R on the rear side is formed. The above-described projection portions 25B of the lifted wall portion 25 are respectively inserted in the grooves 44G of the regulation portions 44R.

The lifted wall portion 25 is biased upward by the biasing members 27 as described above, and when the projection portions 25B are pressed against the upper end portions of the grooves 44G, the lifted wall portion 25 is regulated from being lifted up, and a state where the lifted wall portion 25 has projected upward, by a predetermined height, from the downstream end of the sheet feed tray 44 in the sheet feed direction Z, is kept. The sheet feed tray 44 can be lifted up to a predetermined height that is higher than a position of the sheet feed tray 44 when the lifted wall portion 25 has reached the upper-limit position.

Figure 11:
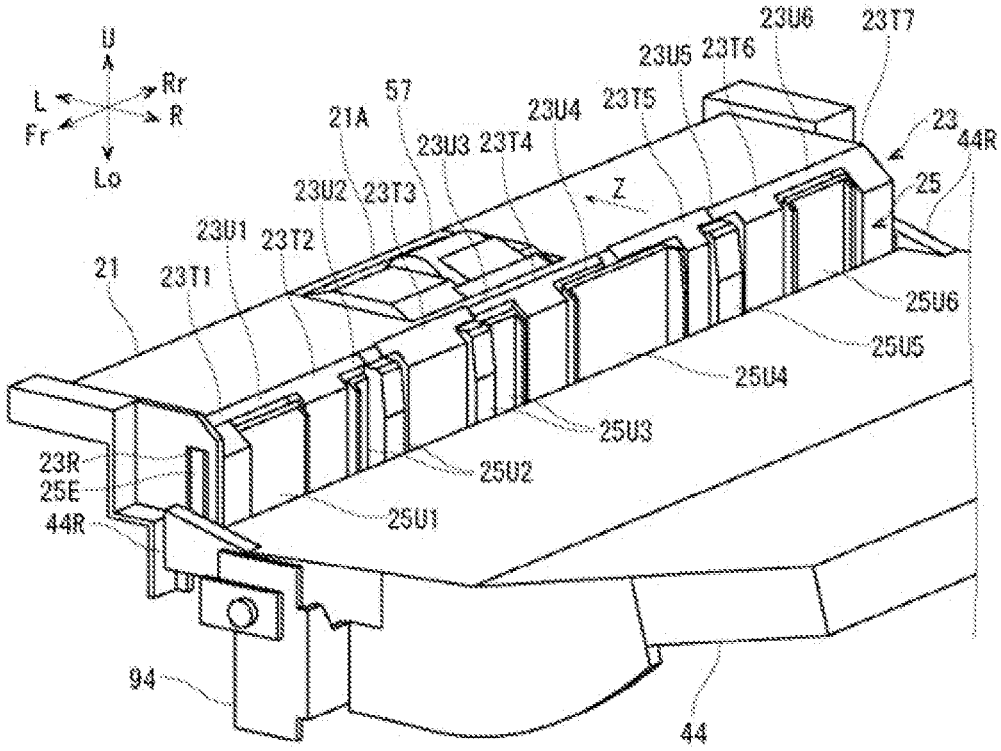
FIG. 11 is a perspective diagram showing a state where the lifted wall portion has been lifted up to an upper-limit position.
Figure 12:
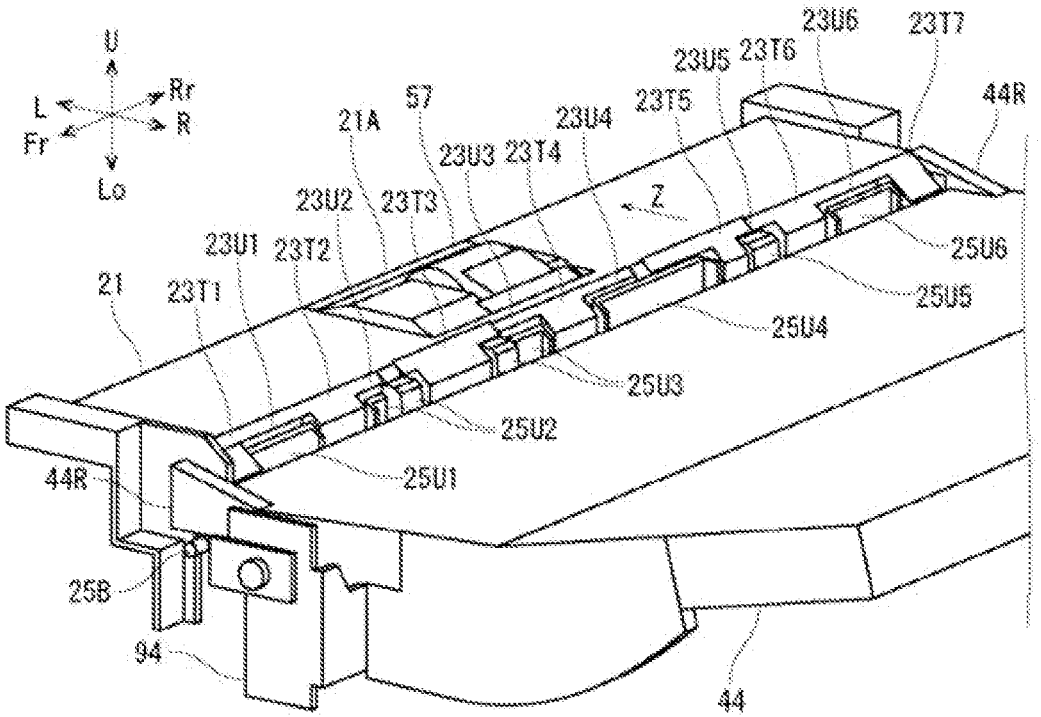
FIG. 12 is a perspective diagram showing a state where the sheet feed tray has been lifted up to an upper-limit position.

Next, an operation of the present embodiment is described (see FIG. 7, FIG. 11, and FIG. 12). FIG. 7 is a perspective diagram showing a state where the lifted wall portion 25 has been lifted down to the lower-limit position. FIG. 11 is a perspective diagram showing a state where the lifted wall portion 25 has been lifted up to the upper-limit position. FIG. 12 is a perspective diagram showing a state where the sheet feed tray 44 has been lifted up to the upper-limit position.

When the lifted wall portion 25 is located at the lower-limit position, the upper end portion of the lifted wall portion 25 is located slightly higher than the lower end portion of the fixed wall portion 23 such that there is no gap between the lifted wall portion 25 and the fixed wall portion 23. In this case, a wall formed by the lifted wall portion 25 and the fixed wall portion 23 is the largest in height, and the capacity of the sheet feed tray 44 (amount of stackable document sheets G) is the largest.

When the sheet feed tray 44 is lifted up by the sheet feed tray lift mechanism 33, the projection portions 25B are pressed to the upper end portions of the grooves 44G of the regulation portions 44R, and the lifted wall portion 25 is lifted up together with the sheet feed tray 44 since the lifted wall portion 25 is biased upward by the biasing members 27. At this time, the projection fitting portions 25T1 to 25T7 of the lifted wall portion 25 slide along the projection portions 23T1 to 23T7 of the fixed wall portion 23, and the recessed fitting portions 25U1 to 25U6 of the lifted wall portion 25 slide along the recessed portions 23U1 to 23U6 of the fixed wall portion 23.

When the end portions 25E at the front and rear ends of the lifted wall portion 25 come in contact with the upper end portions of the restriction portions 23R (see FIG. 11), lifting up of the lifted wall portion 25 is stopped and the lifted wall portion 25 reaches the upper-limit position. When the sheet feed tray 44 is further lifted up, the upper end portions of the grooves 44G of the regulation portions 44R are separated from the projection portions 25B of the lifted wall portion 25, and only the sheet feed tray 44 is lifted up.

When the sheet feed tray 44 reaches the upper-limit position (see FIG. 12), a downstream end in the sheet feed direction Z of an upper surface of the sheet feed tray 44 is located slightly lower than the upper surface of the top plate portion 21. In this case, the wall formed by the lifted wall portion 25 and the fixed wall portion 23 is the smallest in height, and the capacity of the sheet feed tray 44 is the smallest. As described above, the upper end portions of the plurality of projection portions 23T1 to 23T7 and the plurality of recessed portions 23U1 to 23U6 of the fixed wall portion 23 are inclined such that the downstream sides thereof in the sheet feed direction Z are higher. As a result, the document sheet G is fed smoothly from the sheet feed tray 44 towards the top plate portion 21.

When the sheet feed tray 44 is lifted down from the upper-limit position and reaches the position shown in FIG. 11, the upper end portions of the grooves 44G of the regulation portions 44R come in contact with the projection portions 25B of the lifted wall portion 25. When the sheet feed tray 44 is further lifted down, the projection portions 25B are pressed down by the upper end portions of the grooves 44G, and the lifted wall portion 25 is lifted down together with the sheet feed tray 44.

The document sheet conveying device 120 of the present embodiment described above includes: the sheet feed tray 44 on which one or more document sheets G are stacked; the sheet feed mechanism 31 configured to feed, in a predetermined sheet feed direction Z, one of the document sheets G stacked on the sheet feed tray 44; the sheet feed tray lift mechanism 33 configured to lift up and down the sheet feed tray 44; a top plate portion 21 which is adjacent to the sheet feed tray 44 at a downstream side in the sheet feed direction Z and is contacted by a lower surface of the document sheet G having been fed; the fixed wall portion 23 which extends downward from an upstream end of the top plate portion 21 in the sheet feed direction Z and whose position is fixed; and the lifted wall portion 25 extending upward from the downstream end of the sheet feed tray 44 in the sheet feed direction Z and configured to be lifted up and down together with the sheet feed tray 44 along the fixed wall portion 23. With this configuration, the positioning of a downstream end of the document sheets G in the sheet feed direction Z is performed by the wall formed by the fixed wall portion 23 and the lifted wall portion 25. As the sheet feed tray 44 is lifted down, the height of the wall increases, and thus the capacity of the sheet feed tray 44 increases. Therefore, according to the present embodiment, it is possible to achieve a large capacity of the sheet feed tray 44 without enlarging, in the up-down direction, the size of the wall that faces the downstream end of the sheet feed tray 44 in the sheet feed direction Z. As a result, it is possible to vary, in a broad range, the height of the discharge outlet through which the document sheet G is discharged to the discharge tray 43, making it possible to achieve a large capacity of the discharge tray 43, too.

In addition, according to the document sheet conveying device 120 of the present embodiment, the fixed wall portion 23 includes: the plurality of projection portions 23T1 to 23T7 that are provided along the upstream end of the top plate portion 21 in the sheet feed direction Z with intervals therebetween, project toward the sheet feed tray 44, and each have a hollow structure with their lower end portions being open; and the plurality of recessed portions 23U1 to 23U6 that are arranged alternately with the plurality of projection portions 23T1 to 23T7, and the lifted wall portion 25 includes: the plurality of projection fitting portions 25T1 to 25T7 that are respectively fitted in the plurality of projection portions 23T1 to 23T7; and the plurality of recessed fitting portions 25U1 to 25U6 that are respectively fitted in the plurality of recessed portions 23U1 to 23U6. With this configuration, the plurality of projection fitting portions 25T1 to 25T7 slide against the plurality of projection portions 23T1 to 23T7, and the plurality of recessed fitting portions 25U1 to 25U6 slide against the plurality of recessed portions 23U1 to 23U6, and thus it is possible to lift up and down the lifted wall portion 25 smoothly and in a stable attitude.

In addition, the document sheet conveying device 120 of the present embodiment includes the biasing member 27 that biases the lifted wall portion 25 upward, and the sheet feed tray 44 includes the regulation portions 44R that regulate lifting up of the lifted wall portion 25. With this configuration, it is possible to keep a state where the lifted wall portion 25 has projected upward, by a predetermined height, from the downstream end of the sheet feed tray 44 in the sheet feed direction Z.

In addition, according to the document sheet conveying device 120 of the present embodiment, the fixed wall portion 23 includes the restriction portions 23R that restrict lifting up of the lifted wall portion 25 such that the height of the upper end portion of the lifted wall portion 25 does not exceed the height of the upper end portion of the fixed wall portion 23. With this configuration, the lifted wall portion 25 does not interfere with the conveyance of the document sheet G.

In addition, according to the document sheet conveying device 120 of the present embodiment, the sheet feed tray 44 can be lifted up to a predetermined height that is higher than a position of the sheet feed tray 44 when the lifted wall portion 25 has reached the upper-limit position. With this configuration, it is possible to feed the document sheet G even when a small amount of document sheets G are stacked on the sheet feed tray 44.

The present embodiment may be modified as follows.

According to an example provided in the above-described embodiment, the fixed wall portion 23 includes the plurality of projection portions 23T1 to 23T7 and the plurality of recessed portions 23U1 to 23U6, and the lifted wall portion 25 includes the plurality of projection fitting portions 25T1 to 25T7 and the plurality of recessed fitting portions 25U1 to 25U6. However, the fixed wall portion 23 and the lifted wall portion 25 may each be formed in a flat plate shape, and disposed to face each other in the sheet feed direction Z.

According to an example provided in the above-described embodiment, tension coil springs are provided as the biasing members 27 between the top plate portion 21 and the bottom plate portion 26. However, the biasing members 27 may be any members as far as they can bias the lifted wall portion 25 upward. For example, the biasing members 27 may be a compression coil spring provided between the bottom portion 40 and the bottom plate portion 26.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A document sheet conveying device comprising:

a sheet feed tray on which a document sheet is stacked;

a sheet feed mechanism configured to feed, in a predetermined sheet feed direction, the document sheet stacked on the sheet feed tray;

a sheet feed tray lift mechanism configured to lift up and down the sheet feed tray;

a top plate portion which is adjacent to the sheet feed tray at a downstream side, in the sheet feed direction, of the sheet feed tray, is contacted by a lower surface of the document sheet having been fed, and guides the document sheet in the sheet feed direction, a part of the sheet feed mechanism being disposed at the top plate portion;

a fixed wall portion provided to extend downward from an upstream end, in the sheet feed direction, of the top plate portion; and a lifted wall portion provided to face the fixed wall portion and configured to be lifted up and down along the fixed wall portion together with the sheet feed tray, wherein the fixed wall portion includes:

a plurality of projection portions that are provided in a width direction crossing the sheet feed direction with intervals therebetween, project toward the sheet feed tray, and respectively have hollow portions whose lower end portions are open; and a plurality of recessed portions that are arranged alternately with the plurality of projection portions, and the lifted wall portion includes:

a plurality of projection fitting portions that are respectively fitted in the hollow portions of the plurality of projection portions; and a plurality of recessed fitting portions that are respectively fitted in the plurality of recessed portions.

2. The document sheet conveying device according to claim 1, further comprising:

a biasing member configured to bias the lifted wall portion upward, wherein the lifted wall portion includes: a pair of end portions formed to project outward in the width direction crossing the sheet feed direction; and a pair of projection portions respectively projecting from the pair of end portions outward in the width direction, the fixed wall portion includes a pair of restriction portions that extend along an up-down direction, and, when the pair of end portions have been inserted therein, guide the pair of end portions to move in the up-down direction, and the sheet feed tray includes a pair of regulation portions that project from both ends in the width direction toward the lifted wall portion, abut on the pair of projection portions from above, and regulate the lifted wall portion from being lifted up.

3. The document sheet conveying device according to claim 2, wherein the pair of restriction portions respectively have upper edge portions and restrict the lifted wall portion from being lifted up when the pair of end portions abut on the upper edge portions, at an upper-limit position where a height of an upper end portion of the lifted wall portion does not exceed a height of an upper end portion of the fixed wall portion.

4. The document sheet conveying device according to claim 3, wherein after the lifted wall portion reaches the upper-limit position and stops, the sheet feed tray can be lifted up to a predetermined height that is even higher.

* * * * *